US008040366B2

(12) United States Patent
Yaguchi

(10) Patent No.: US 8,040,366 B2
(45) Date of Patent: Oct. 18, 2011

(54) THERMAL PRINTER AND CONTROL METHOD THEREOF

(75) Inventor: Hiroyuki Yaguchi, Ichikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 150 days.

(21) Appl. No.: 12/530,254

(22) PCT Filed: Dec. 25, 2008

(86) PCT No.: PCT/JP2008/073938

§ 371 (c)(1),
(2), (4) Date: Sep. 8, 2009

(87) PCT Pub. No.: WO2009/087946

PCT Pub. Date: Jul. 16, 2009

(65) Prior Publication Data

US 2010/0091080 A1 Apr. 15, 2010

(30) Foreign Application Priority Data

Jan. 8, 2008 (JP) ..... 2008-001644

(51) Int. Cl.
*B41J 2/325* (2006.01)

(52) U.S. Cl. ..... 347/212

(58) Field of Classification Search ..... 347/172, 347/174, 176, 212

See application file for complete search history.

(56) References Cited

U.S. PATENT DOCUMENTS

| | | | | |
|---|---|---|---|---|
| 4,815,872 | A | 3/1989 | Nagashima | 400/120 |
| 6,250,824 | B1 * | 6/2001 | Ogiyama | 400/120.03 |
| 6,398,433 | B1 | 6/2002 | Kubota | 400/120.05 |

FOREIGN PATENT DOCUMENTS

| | | |
|---|---|---|
| EP | 0 965 454 A2 | 12/1999 |
| JP | 2004-82610 | 3/2004 |
| JP | 2006-315215 | 11/2006 |

OTHER PUBLICATIONS

International Search Report and Written Opinion in PCT/JP2008/073938.

* cited by examiner

*Primary Examiner* — Huan Tran
(74) *Attorney, Agent, or Firm* — Fitzpatrick, Cella, Harper & Scinto

(57) ABSTRACT

When printing on a printing medium, a second image adjacent to a first image, which is already printed, control is performed such that the trailing edge of a first coating layer of the first image transferred onto the printing medium does not reach the trailing edge of the first image, and the leading edge of a second coating layer transferred onto the second image is either the same as the trailing edge of the first coating layer of the first image or is made to overlap with the trailing edge of the first coating layer.

15 Claims, 7 Drawing Sheets

THERMAL PRINTER AND CONTROL METHOD THEREOF

TECHNICAL FIELD

The present invention relates to a thermal printer that prints an image on a printing medium using an ink sheet, which has a plurality of sets, each set having sublimation dye-based ink portions and a thermo-melting coating material, repeatedly arranged in the longitudinal direction of the ink sheet, and a control method thereof.

BACKGROUND ART

A large number of printing apparatuses are being produced which are capable of printing an image based on image data captured from digital still cameras, digital video cameras, cellular telephones and the like. One example of a printing method being adopted for such printing apparatuses is a thermal transfer method. In printing apparatuses using this thermal transfer method (hereinafter, called "thermal printers"), multiple heat generating elements are arranged in the main scanning direction of a thermal head and selectively driven to generate heat according to print data. The heat melts the ink of the dye ink portion of the ink sheet to transfer the melted ink to a paper which has a dye receiving layer on its front face, such that the printing of an image of one main scanning direction is performed. Further, by conveying the paper in the sub-scanning direction in synchronism with the printing of an image of one main scanning direction is completed, an image composed of multiple main scanning lines is printed on the paper.

Among thermal printers, sublimation thermal printers print by sublimating the ink of an ink sheet from a solid to a vapor and causing it to affix to a paper. Because this type of thermal printer can control the heat quantity of the thermal head and the number of driving times of the thermal head and thereby modify the density of each pixel of a printed image, it is capable of printing an image with smooth gradients and rich tonality. Because of this, the thermal printers are widely used for photograph printing.

FIGS. 7A and 7B depict views illustrating an ink sheet for use with a general thermal printer. FIG. 7A depicts an ink sheet for color printing and FIG. 7B depicts an ink sheet for monochrome printing.

In the ink sheet depicted in FIG. 7A, each sublimation dye-based color ink portion, yellow (Y) 701, magenta (M) 702, cyan (C) 703, is arranged in frame-sequential order on the upper surface, in the longitudinal direction of the ink sheet. Then, after the color ink portions, an overcoat portion (OP) (transparent resin of a thermo-melting coating material) 704 is provided in order to protect the formed image layer transferred onto a paper. Also, between each ink portion as well as between cyan (C) 703 and the overcoat portion 704, cue markers 705 for cue position detection of each portion is arranged. However, this does not apply to configurations using special purpose ink sheet (FIG. 7B) for black and white image printing. In FIG. 7B, the black sublimation dye-based ink portion 710 and the overcoat portion 711, respectively, are repeatedly arranged in frame-sequential order. Also, a marker 712 for cue position detection of each portion is provided between the black ink sheet portion 710 and the overcoat portion 711. It should be noted that the arrows in FIGS. 7A and 7B indicate the conveyance direction of the ink sheet.

FIG. 8 depicts a view illustrating a cross-section of a paper onto which Y, M and C ink (sublimation dye) is transferred using the ink sheet of FIG. 7A.

In FIG. 8, reference numeral 801 denotes a dye-receiving layer of a paper, reference numeral 802 denotes a transferred yellow (Y) dye sublimation layer, reference numeral 803 denotes a magenta (M) dye sublimation layer, reference numeral 804 denotes a cyan (C) dye sublimation layer and reference numeral 805 denotes a overcoat (OP) layer.

FIG. 9 depicts a view explaining a printing example of an image printed using the ink sheet shown in FIG. 7A.

When using this type of ink sheet to print a single image, processing is done to thermally transfer, as one set, the dye ink portions of the three colors Y, M and C as well as the overcoat portion to a paper. Therefore, the ink sheet stored in the ink sheet cartridge has a plurality of sets, each having color ink portions of Y, M and C and the OP portion (overcoat portion), as many as the number of images that the ink sheet guarantees. Normally, the length (in the longitudinal direction of the ink sheet) of each of the Y, M and C color ink portions as well as the OP portion is set to a length by which it is possible to print an image of the longitude size of a target paper.

For example, on a thermal printer which uses a paper roll as a paper, the length of the sub-scanning direction of an image relative to the main scanning direction, which is in the alignment direction of the heating elements of the thermal head, is optionally set according to a cutting position of the roll paper. Accordingly, as shown in FIG. 9, it is also possible to print a panorama- (wide-) sized image 910 comprising two frames, which use two sets of color ink portions of Y, M, C and OP portions. In FIG. 9, the left frame (first image) 911 of the panoramic image 910 is transferred as resins of the color ink portions 701-703 of Y, M, C and the OP portion 704 for the first frame of the ink sheet and printed on the paper. In the same way, the right frame (second image) 912 is transferred as resins of the color ink portions 701-703 of Y, M, C and the OP portion 704 for the second frame of the ink sheet and printed on the paper. Further, by continuing printing of images for the third and fourth frames, adjacent to the second image 912 of the panoramic image 910, it is possible to print an image having an optional length in the sub-scanning direction (the sheet conveyance direction).

FIG. 10 depicts a cross-sectional view of an edge position of a first frame image on a paper on which the first frame image is printed In this FIG. 10, reference numeral 1001 denotes a paper having an ink-receiving layer, on which the first image is printed using a sublimation-type heat transfer. Because the OP layer 1005 carries out a protective role, when compared to the color ink layers, the Y, M and C colors (1002 to 1004), it is transferred longer on the paper 1001 by a difference 1006 corresponding to several numbers of dots of image. However, when transferring each frame of neighboring images, as with the panorama-sized image as shown in FIG. 9, the ink sheet is stuck to the paper at the point where the first image and second image come into contact if printing of the first image is carried out using Y, M, and C color ink portions and OP portion. This is because, at the difference 1006 of the OP layer 1005, the Y color ink portion 701, which is first used to transfer the second image, is contact-pressured to transfer the Y color ink on the OP layer 1005. That is, in the portion at which the first and second images come into contact, when the Y color of the second image is transferred on the OP layer 1005, in which the OP portion 1005 was transferred for the first image, and the OP layer 1005 is reheated by the thermal head and melted, causing the Y color ink portion 701 of the ink sheet to stick to the OP layer 1005 due to the melting of the transferred OP layer 1005.

Japanese Patent-Laid-Open No. 2006-315215 describes a method for solving the problem that an ink sheet is stuck to a printing paper if a thermal transfer printing is carried out when a printing sheet for thermal dye sublimation printing is not set. Also, Japanese Patent-Laid-Open No. 2004-082610 discloses a method for printing an image larger than a given size like a panoramic image using a standard ink ribbon. However, neither of these references either discusses or provides a solution to the problems.

DISCLOSURE OF INVENTION

It is an aspect of the present invention to eliminate the above-mentioned problems with the conventional technology.

It is a characteristic of the present invention to, when printing multiple adjacent images on a printing medium, wherein the images are formed by transferring a set of ink portion and a coating portion, prevent an ink sheet from sticking to the printing medium on which an image is already printed at the point at which the images come into contact.

According to the present invention, there is provided a thermal printer for printing an image on a printing medium using an ink sheet that repeatedly arranges a set, which contains a plurality of sublimation dye-based color ink portions and a thermo-melting coating material, the printer comprises:

a printing unit configured to print an image on a printing medium using a set of the plurality of sublimation dye-based color ink portions and the thermo-melting coating material of the ink sheet; and a control unit configured to, in a case that printing a second image, capable of being printed using a set of the plurality of sublimation dye-based ink portion and the thermo-melting coating material of the ink sheet, adjacent to a first image printed on the printing medium, control such that, (a) the trailing edge of a first coating layer, which is transferred with respect to the first image printed by the printing unit, is at a position which does not reach the trailing edge of the first image, and (b) the leading edge of a second coating layer, with respect to the second image printed by the printing unit, is either the same as the trailing edge of the first coating layer or overlaps the trailing edge of the first coating layer.

According to the present invention, there is provided a thermal printer for printing an image on a printing medium using an ink sheet having a set of a sublimation dye-based ink portion and a thermo-melting coating material, which is frame-sequentially arranged repeatedly, the thermal printer comprises:

printing means for printing an image on a printing medium using a set of the sublimation dye-based ink portion and the thermo-melting coating material of the ink sheet; and control means for, in a case that printing a second image, capable of being printed using a set of sublimation dye-based ink portion and the thermo-melting coating material of the ink sheet, adjacent to a first image printed on the printing medium, controlling such that, (a) the trailing edge of a first coating layer, which is transferred with respect to the first image by the printing means, is at a position which does not reach the trailing edge of the first image, and (b) the leading edge of a second coating layer, with respect to the second image printed by the printing means, is either the same as the trailing edge of the first coating layer or overlaps the trailing edge of the first coating layer.

Further features of the present invention will become apparent from the following description of exemplary embodiments with reference to the attached drawings.

BRIEF DESCRIPTION OF DRAWINGS

The accompanying drawings, which are incorporated in and constitute part of the specification, illustrate embodiments of the invention and, together with the description, serve to explain the principles of the invention.

BEST MODE FOR CARRYING OUT THE INVENTION

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

Figure 1:
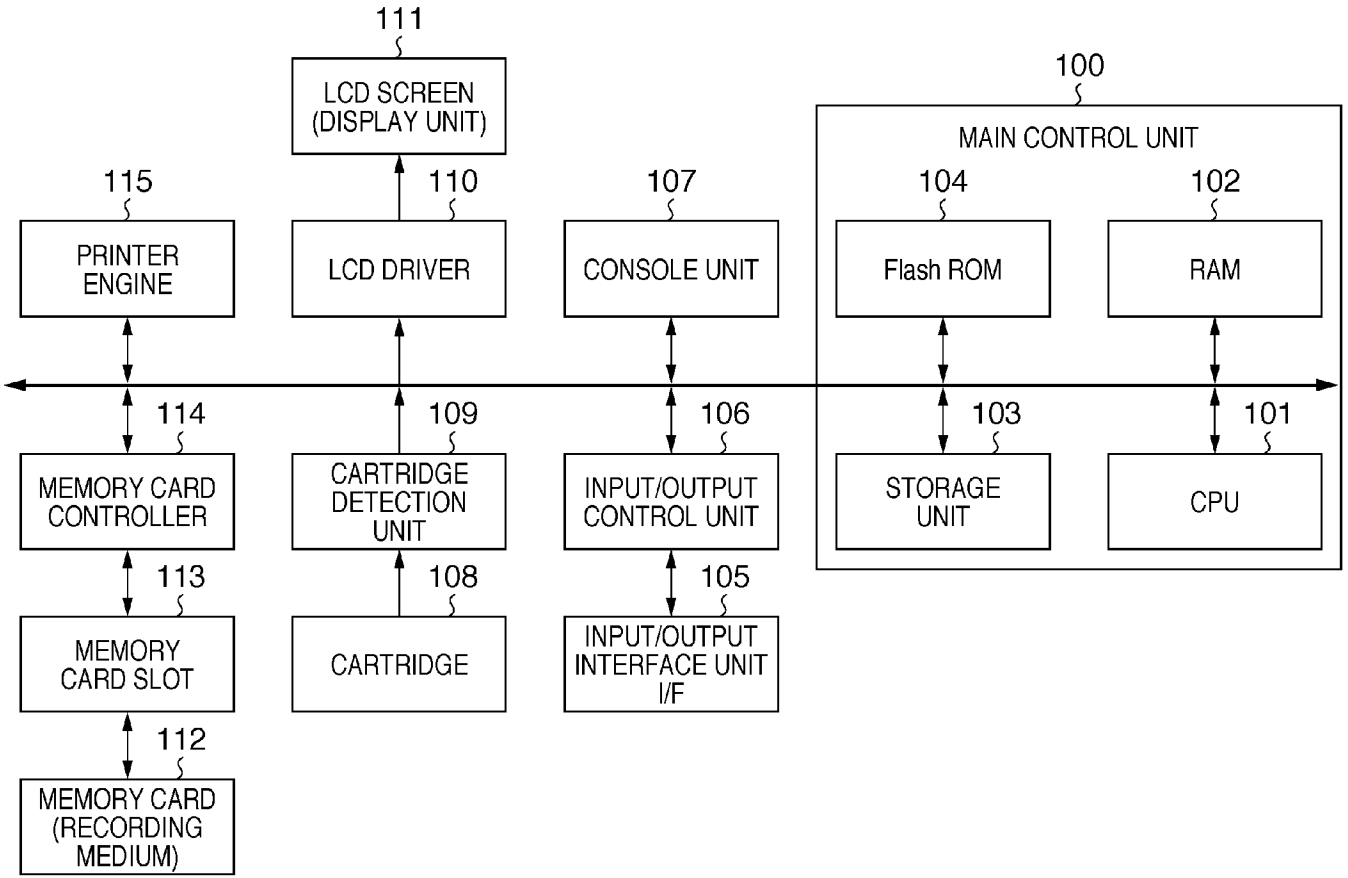
FIG. 1 is a block diagram explaining a construction overview of a thermal printer according to an exemplary embodiment of the present invention.

FIG. 1 is a block diagram explaining a construction overview of a thermal printer according to an exemplary embodiment of the present invention.

A memory card 112 is inserted in a card slot 113, and the memory card 112 stores image data of a plurality of images. It should be noted that, in addition to the memory card 112, the thermal printer is also capable of connecting to a digital camera (not shown) via a USB connector of an input/output interface unit 105, directly receiving image data from the digital camera and printing an image based on the image data. The printer is also capable of connecting, via a USB connector, to a PC (not shown), receiving print data from the PC and printing it. Further, the input/output interface unit 105 may also be equipped with a function of sending and receiving data via infrared communications or the like.

The main controller 100 controls all operations of this printer and has a CPU 101, a RAM 102, a storage unit 103, and a flash ROM 104. The CPU 101, in accordance with a control program stored in the flash ROM 104, executes operation processing, involving printer control and arithmetic processing. The CPU 101 further carries out extra processing on image data, and executes processing to generate print data required for printing and stores it in the RAM 102. The RAM 102 is also used for temporary storage of image data, and as a work area for image resize processing and all types of programs. Also, the flash ROM 104 stores system control programs and operating values as well as parameters. The storage unit 103 is constructed from an HDD (hard disk drive), flash memory or the like, and is used to store image data from a plurality of images as well as other files. For connecting the printer with an external device such as a digital camera or PC, the input/output interface unit 105 may offer, for example, interfaces such as USB and Bluetooth. The input/output controller 106 administers control of this interface.

As referred to in FIG. 3 and will be discussed later, a console unit 107 has an LCD screen 111, various types of control buttons and the like. While confirming processing content using the GUI displayed on the LCD screen 111, a user operates the console unit 107 and inputs various types of instructions. Processing for display on the LCD screen 111 is controlled by the LCD driver 110.

The memory card 112 is installed in the card slot 113, and the memory card controller 114 controls reading out image data from the memory card 112 and transferring the read image data to the main controller 100.

A printer engine 115 prints an image on a printing paper (printing medium) based on image data. The printer engine 115 will now be explained with reference to FIG. 2. The printer engine 115 has a thermal head as well as a sheet feed motor and driving mechanisms, a sheet/feed discharge mechanism which executes sheet feed/discharge, and the like. Further, the printer engine 115 is equipped with a cartridge 108 (FIG. 1) which contains the ink sheet and a cartridge detection unit 109 which detects types of the cartridge 108. It should be noted that, while it is not depicted in FIG. 1, in order to supply the electrical power required for the operation of the printer, the printer is equipped with a power supply circuit as well as circuit boards having various types of integrated circuits and an electrical element and the like.

Figure 2:
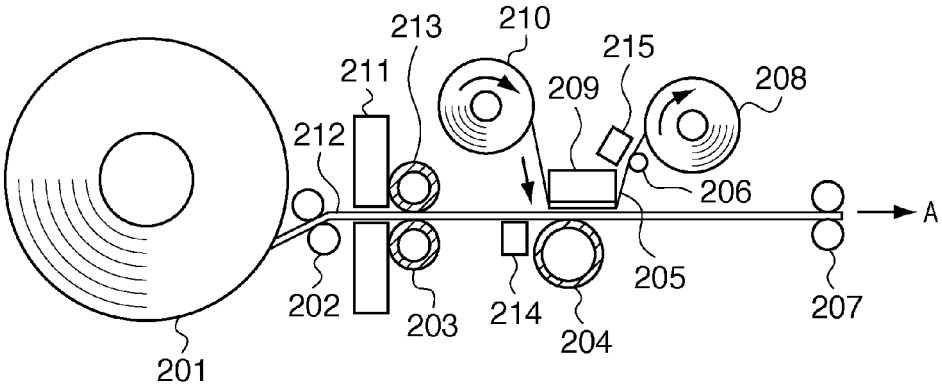
FIG. 2 depicts a view explaining the construction of a printer engine of the thermal printer according to the embodiment of the present invention.

FIG. 2 depicts a view explaining the construction of the printer engine 115 of the thermal printer according to the embodiment of the present invention.

A paper (printing medium) 212 is, by the rotation of a feed roller 202, pulled off from a roll paper 201, which is spooled in a rolled state, and the paper 212 is sent to a grip roller 203 whose rotation is controlled by a stepping motor (not shown). On the opposite side of the grip roller 203, a pinch roller 213 is provided such that the paper 212 is nipped between them, and the paper 212 is conveyed along the path from the grip roller 203 to a platen roller 204 and a discharge roller 207. A thermal head 209 is arranged on the opposite side of the platen roller 204, and an ink sheet 205 passes through a space between the thermal head 209 and the paper 212. The ink sheet 205 is fed from an ink sheet supply bobbin 210 of the ink sheet supply side, passes through the space between the thermal head 209 and paper 212, and the ink sheet 205, winding control over which is performed by a rotational drive, is wound onto a winding bobbin 208 of the winding side of the ink sheet. Here, an ink sheet guide roller 206 is provided in order to smoothly convey the ink sheet 205. It should be noted that the thermal head 209 is a line-type of thermal head, comprising multiple heating elements arranged in a line of length at least equivalent to the width of the paper 212 (in the main scanning direction), the paper 212 is conveyed in the sub-scanning direction, orthogonal to the thermal head 209 and an image is transferred (printed) on the paper 212.

Figure 7A:
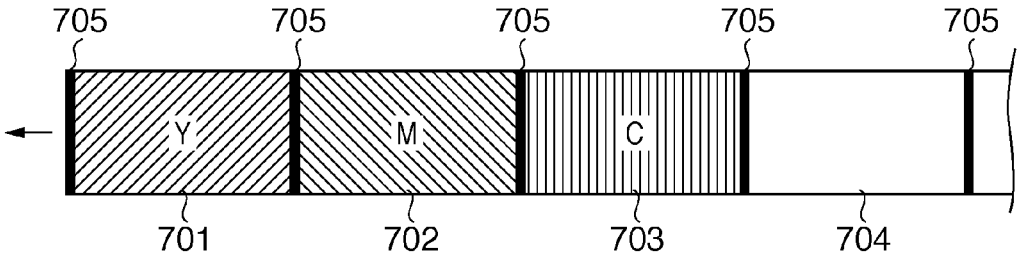
FIGS. 7A and 7B are views explaining a general ink sheet for use with the thermal printer.

As explained with reference to FIG. 7A, the ink sheet 205 includes the sublimation dye-based color ink portions yellow (Y), magenta (M) and cyan (C) and transparent resin (OP portion or coating material) which forms a coating layer of the transferred image. Then, each set, which is formed of color ink portions and coating material (coating portion) arranged in frame-sequential order, is repeatedly provided in the longitudinal direction of the ink sheet. Also, a cue marker 705 is provided between each of the color ink portions as well as between an ink portion and coating material (overcoat portion).

When an image is transferred onto a paper, by the crimping operation of the platen roller 204, the paper 212 pushes against the thermal head 209, and the ink sheet 205 contacts with the heating elements of the thermal head 209 and the paper 212. In this state, the heating elements are thermally driven by the CPU 101 in accordance with print data. An image of one main scanning direction is formed by transferring the sublimation ink sublimated by the thermal driving of the heating elements and fixing, to the receptive layer of the paper 212, which is contact-pressured by the platen roller 204.

Further, by control of the CPU 101, driving force of the motor (not shown) is transferred via gears (not shown) to the grip roller 203. Then, with the paper 212 in a state whereby it is nipped by the grip roller 203 and the pinch roller 213, for forming of each image of one main scanning direction, the grip roller 213 is rotationally driven and the paper 212 is conveyed by the sub-scanning length of the image of one main scanning direction. Further, when the image of one main scanning direction has been formed, the ink sheet 205 is wound around the ink sheet winding bobbin 208 by the sub-scanning length of the image of one main scanning direction using the motor (not shown), the rotation of the motor is controlled by the CPU 101. As the result, in order to print an image of next one main scanning direction, an ink sheet portion which has not yet been sublimated is fed to the portion at which it contacts with the thermal head 209. The above described operations are repeated to transfer an image of yellow using the ink portion (Y) 701 to the paper 212, and then the paper 212 is fed back to the initial position and then an image of magenta (M) using the ink portion (M) 702 is transferred on the paper 212. By repeating the operations, a full color image is transferred on the paper 212 using the color ink portions 701 to 703.

In this manner, after transfer of the colors Y, M and C is finished, the transparent resin (OP portion) 704 is melted by heat from the heating elements of the thermal head 209 and transferred to the paper 212, and a coating layer is formed which coats the surface of the full color image which has been transferred to the paper 212. When printing of a color image is completed in this manner, the roll sheet is cut by a cutter 211, and the paper 212 on which the color image is formed is discharged from the printer by the rotation of the discharge roller 207. Reference numeral 215 denotes a sensor which detects the cue marker 705 of the ink sheet 205. Reference numeral 214 denotes a paper detection sensor for detecting the paper 212.

Figure 3:
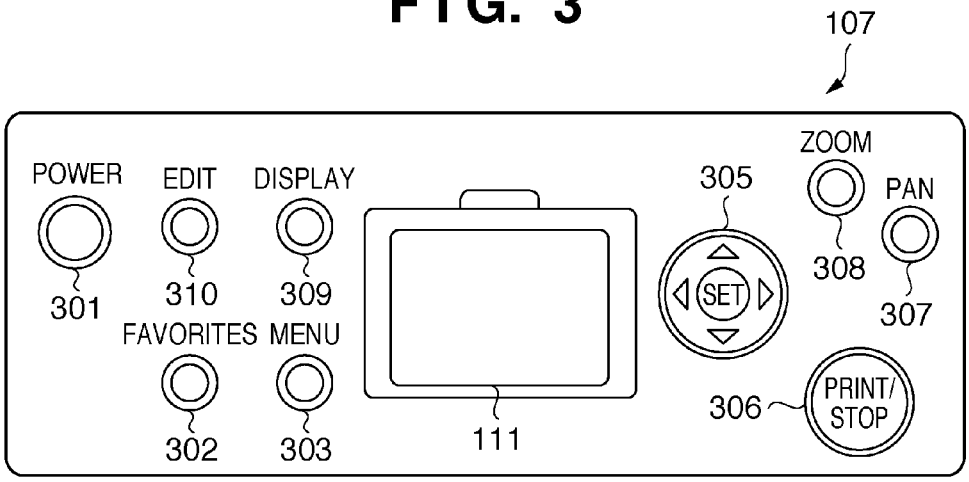
FIG. 3 depicts an external view of a console unit of the thermal printer according to the embodiment of the present invention.

FIG. 3 depicts a view illustrating the console unit 107 of the thermal printer according to the embodiment of the present invention.

The control unit 107 has a power button 301 which carries out printer power on/off, a print/stop button 306 by which instructions are given regarding printing execution/stop, and an LCD 111 which displays a GUI (graphical user interface) screen.

After electric power is supplied by pressing the power button 301, image data stored in the memory card 112 is read out and images corresponding to the image data are displayed on the LCD 111. From this state, a user selects, using the cross key/setting button 305, an image the user wants to print and carries out print settings. That is, by pressing a menu button 303, transition is made to print copies and settings screen. Further, by an edit button 310 press, transition is made to an image data trimming edit screen and an image trimming size can be determined by pressing a zoom button 308 area or a pan button 307. Also, in the screen selected by a display button 309, it is also possible to display information such as image file name and size. Moreover, by pressing a favorites button 302, it is possible to transition to a selection screen of editing functions comprising calendar creation, multi-layout creation (layout and alignment of multiple images) and panoramic image creation. After selection of an image and completion of all types of print settings in this manner, by pressing the print/stop button 306, the print processing of the thermal printer commences.

Explained below are the print operations of the thermal printer according to the embodiment of the present invention.

Figure 4:
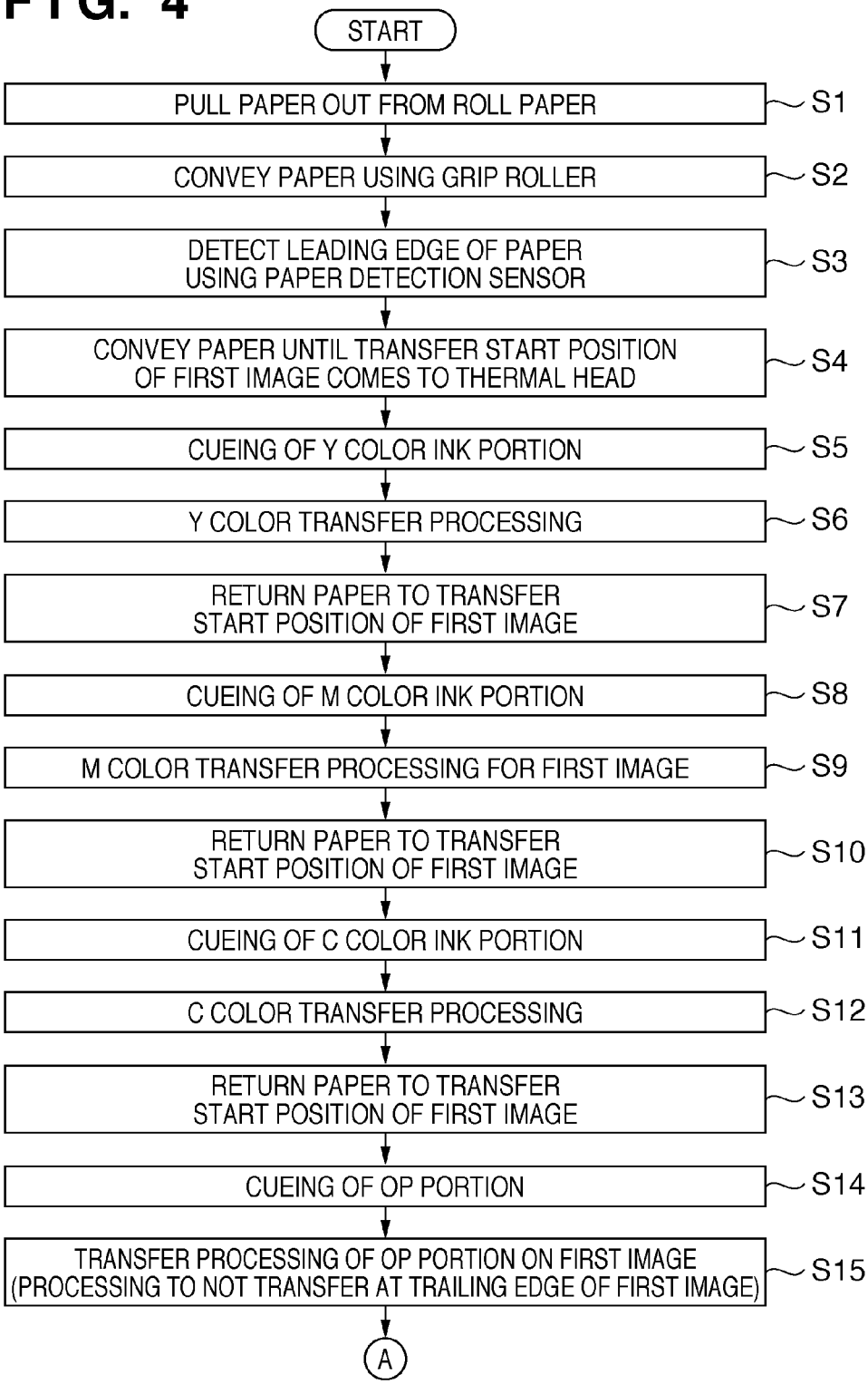
FIGS. 4 and 5 are flowcharts explaining print processing implemented by the thermal printer according to the embodiment of the present invention.
Figure 5:
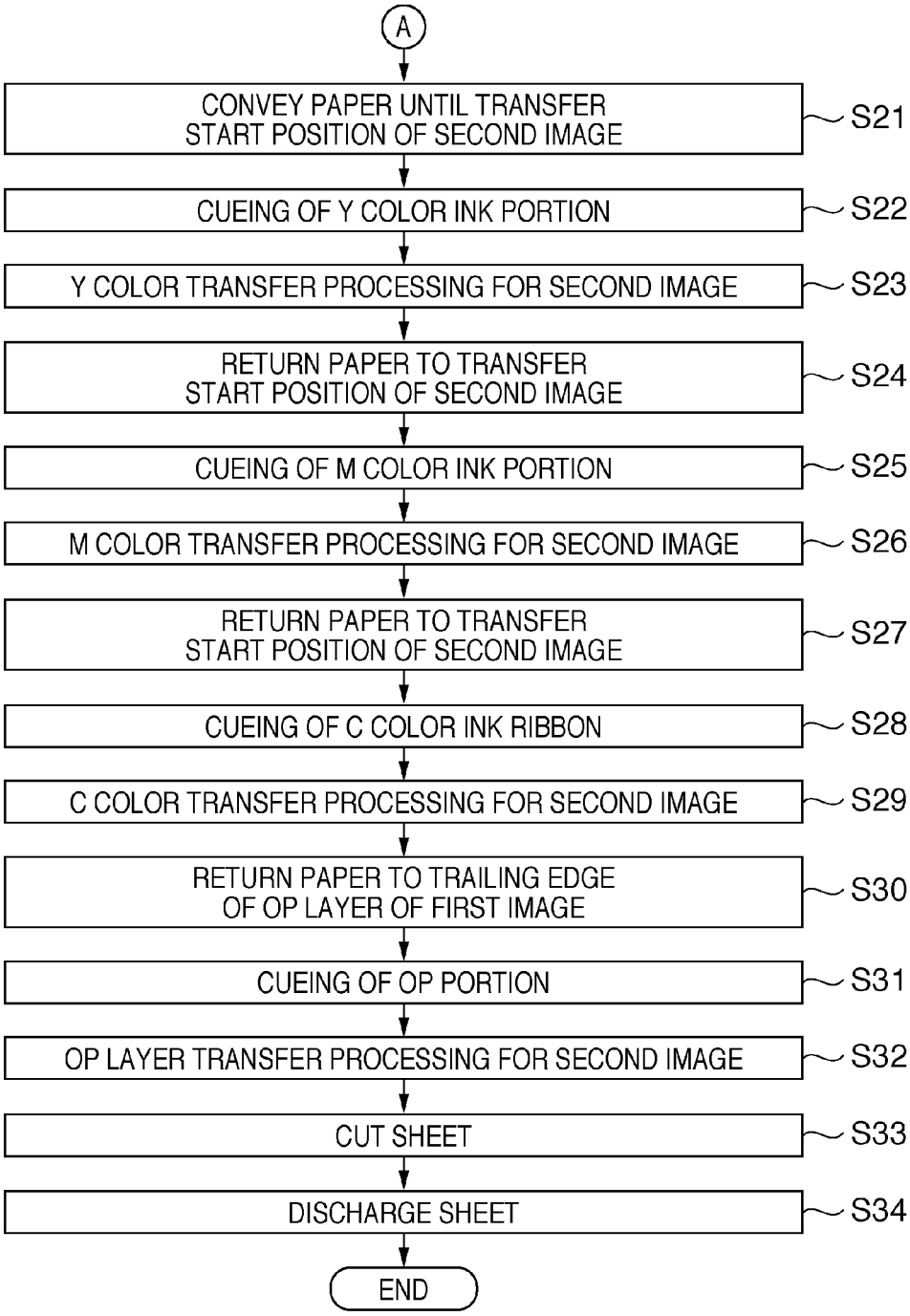
Figure 9:
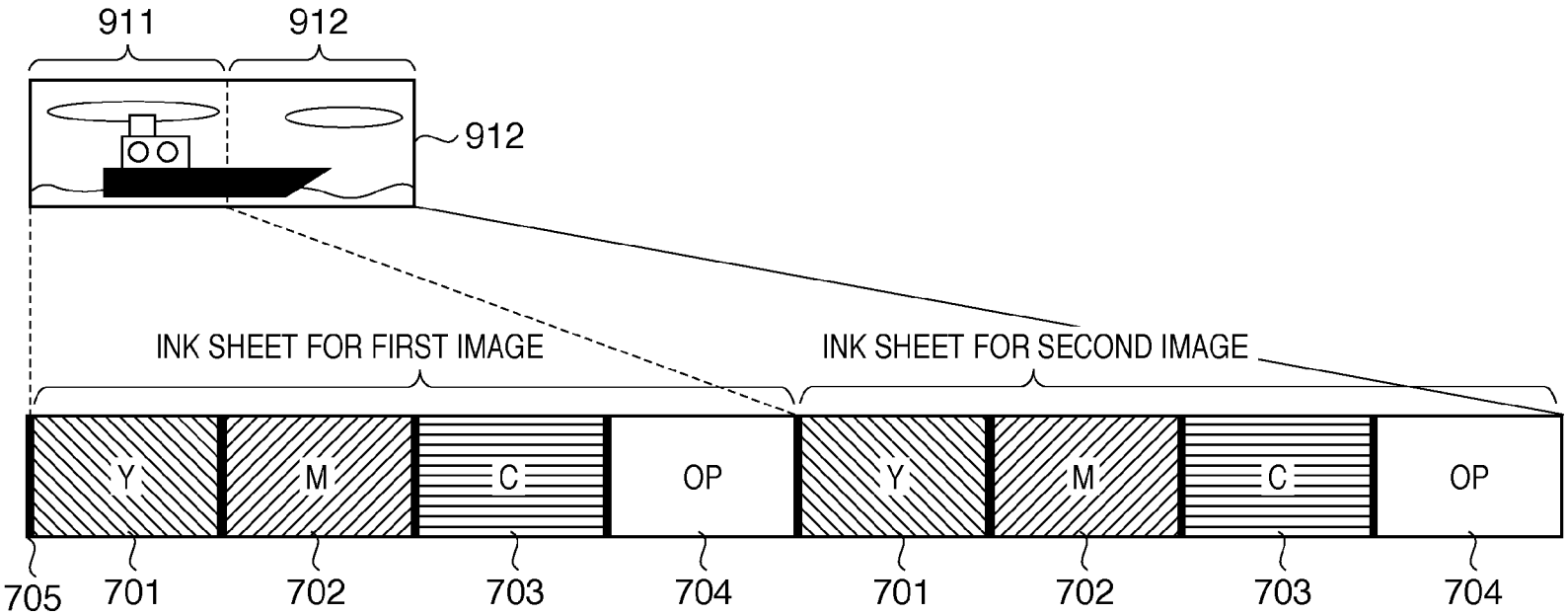
FIG. 9 depicts a view explaining a printing example of an image printed using the ink sheet shown in FIG. 7A.
Figure 10:
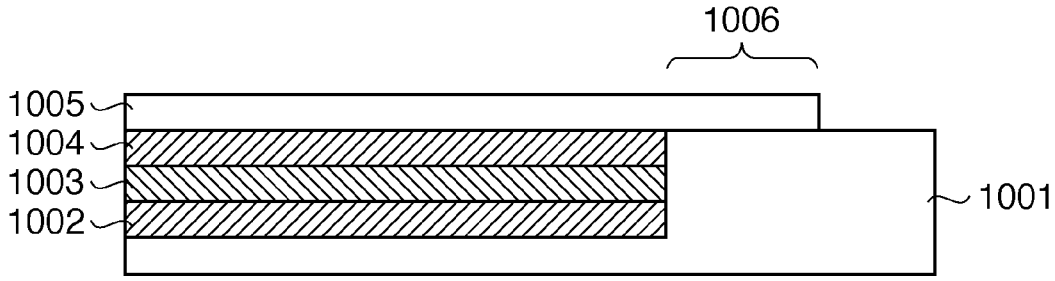
FIG. 10 depicts a cross-sectional view of an edge position of a first frame image on a paper on which the first frame image is printed.

FIGS. 4 and 5 are flowcharts explaining print processing of the thermal printer according to the embodiment of the present invention. It should be noted that the program which executes this processing is stored in the flash ROM 104 and is executed under the control of the CPU 101. The processing depicted in this flowchart is, as depicted in the afore-mentioned FIG. 9, processing to be performed when a panoramic (wide) image is printed with length double the length of one image and for which two sets of portions of the ink sheet are used.

Figure 6:
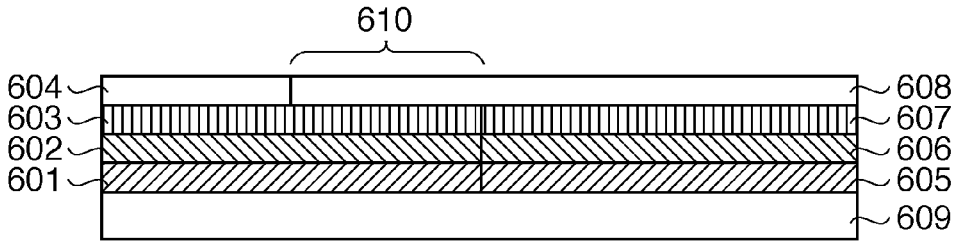
FIG. 6 depicts a view illustrating a cross-section of a connecting portion of a first image and a second image when printing a panoramic image according to the embodiment of the present invention.

Further, FIG. 6 depicts a view illustrating a cross-section of a connecting portion of a first image 911 and a second image 912 when printing a panoramic image 910 (FIG. 9) in the embodiment of the present invention. Below, an explanation will be made with reference to FIGS. 4 through 6. It should be noted that the first and second images are each of size such that printing is possible with a single set of sublimation dye color ink portions of Y, M and C and a thermo-melting coating material (OP portion).

First, in step S1, the CPU 101 rotationally drives the feed roller 202 with the paper 212 in a nip, and the paper 212 is pulled out from the roll paper 201 and conveyed to the nip of the grip roller 203 and the pinch roller 213. Then, in step S2, the paper 212 is conveyed by the rotation of the grip roller 203. After the step S2, conveyance of the paper 212 is performed by the rotation of the grip roller 203, which is drive-controlled by a stepping motor (not shown). The stepping motor is rotationally driven only a number of steps of a pulse signal output from the CPU 101, and after the leading edge of the paper 212 is detected by the paper detection sensor 214, conveyance position control of the paper 212 by the CPU 101 is carried out in an open loop. In the thermal printer according to the embodiment of the present invention, the three steps of the pulse signal which drives the stepping motor conveys the paper 212 by 0.0845 mm.

Next, in step S3, the leading edge of the paper 212, which is conveyed by the rotation of the grip roller 203, is detected by the paper detection sensor 214. Then, in step S4, the paper 212 is conveyed by a pre-determined number of driving steps of the stepping motor, in order that the position above the paper 212 onto which transfer of the first image 911 of the panoramic image to be printed comes to the position of the thermal head 209. Next, the process proceeds to step S5, the ink sheet winding bobbin 208 is wound and the Y ink portion of the ink sheet (701 in FIG. 7A) is cued. Here, the ink sheet is wound until the cue marker 705 of the Y ink portion (differentiation is made possible by a double overstrike lines only on the cue marker of Y) is detected by the cue marker detection sensor 215. In this manner, when the Y ink portion 701 of the ink sheet is finished cueing, the platen roller 204, which was moved away during sheet conveyance and cueing, is contact-pressured to the thermal head 209 in a manner such that the paper 212 and ink sheet 205 are sandwiched between the platen roller 204 and the thermal head 209.

Next, the process proceeds to step S6 and the CPU 101 reads out image data of the memory card 112 and processes the image data to generate print data and stores the print data in the RAM 102. Then, the print data stored in the RAM 102 is read out and transferred to a driver circuit (not shown) of the thermal head 209, and the heating elements of the thermal head 209 are thermally driven by a head control signal in accordance with the print data. In this way, by heating the Y ink portion of the ink sheet 205 in accordance with the print data, Y ink is sublimated and fixed onto the paper 212 with which it is in contact and an image of one main scanning direction is printed (transferred). When the image of one main scanning direction is transferred by the thermal head 209, the paper 212 is then conveyed by the sub-scanning direction length of the image of one main scanning direction, by the rotation of the grip roller 203. By repeating those processing for the entire image, the Y color of the first image 911 is transferred in step S6. That is, in the transfer processing of step S6, the dye sublimation layer 601 (FIG. 6) of the yellow (Y) color of the first image 911 of the panoramic image 910 is formed onto the dye-receiving layer 609 of the paper 212. It should be noted that, in the step S6, when, for example, the size of the first image 911 is an L size (89×127 mm), the grip roller 203 is rotated by rotating the stepping motor 4400 steps and the paper 212 is conveyed for the length corresponding to the longitudinal size of the first image 911 in the A arrow direction of FIG. 2.

In this way, when printing of an image of the Y color has finished, the process proceeds to step S7, the platen roller 204 moves away to a retracted position, and it becomes possible for the paper 212 and ink sheet 205 to move freely. Then, the grip roller 203 is rotationally driven, for example 4400 steps, in the direction opposite to the conveyance direction during printing, and the paper 212 is fed back in the opposite direction to the arrow A (FIG. 2) such that the initial position of the first image 911 of the paper 212 comes to the position of the thermal elements of the thermal head 209. Then, the process proceeds to step S8 and, in the same manner as in step S5, while winding the ink sheet on the winding bobbin 208, the cue marker 705 of the M color portion is detected and cueing of the M color portion is carried out. Then the process proceeds to step S9, and, so as to overlap with the image portion printed with the Y color, similarly to step S6, the M color of the first image 911 is transferred using the M color portion on the image of Y color. Then, after transfer processing of the M color is complete, in step S10, similarly to step S7, the platen roller 204 is moved away to the retracted position and the paper 212 is fed back such that the initial position of the first image 911 comes to the position of the heating elements of the thermal head 209. In this way, the dye sublimation layer 602 (FIG. 6) of magenta (M) color of the first image 911 is formed.

Then, in the C color print processing steps S11 through S13, similarly to the M color print processing steps S8 through S10, the C color of the first image 911 is transferred using the C color portion, and, on the magenta layer 602 (FIG. 6) of the paper 212, a cyan layer 603 of the first image 911 is formed. In this way, at the point in time at which step S13 is finished, a state is reached whereby the initial position of the first image 911, of which Y, M and C inks have been transferred to the paper 212, is fed back to the position of the heating elements of the thermal head 209.

Next, the process proceeds to step S14, and cueing of the OP portion 704 of the ink sheet is carried out. Then, in step S15, by thermally driving the heating elements of the thermal head 209, a transparent coating layer is formed using the transparent resin (OP portion) 704 on the surface of the first image 911, which has been formed using the Y, M and C ink portions. However, the transfer of the OP portion 704 terminates at a position at which the paper has been conveyed 4220 steps from the initial position of the first image 911. Therefore, with regard to the 4400 step length of the first image 911, an area of 180 step length (corresponding to 610 of FIG. 6) occurs wherein an OP layer 604 is not transferred (formed). In this way, when forming the OP layer 604 onto the first image, the conveyance length which the paper 212 is conveyed is shortened by a fixed length (for example, 180 steps) so as to be less than the conveyance length (corresponding to 4400 steps) when transferring the first image 911 (here, the shortened length corresponds to 180 steps).

In this way, as depicted in FIG. 6, the overcoat (OP) layer 604 of the first image of the panoramic image is formed. Here, by the 180 step difference with the dye sublimation layer discussed above, a gap 610 (about 5 mm) is created between the trailing edge of the layers 601 to 603 of the first image of the panoramic image and the trailing edge of the overcoat (OP) layer 604. By the processing of steps S1 through S15, as explained above, the first image 911 of the panoramic (wide) image 910 is printed on the paper 212.

Next, after forming of the OP layer 604 of the first image 911 is completed, the process proceeds to step S21 (FIG. 5), the platen roller 204 moves away to the retracted position, and it becomes possible for the paper 212 and ink sheet 205 to move freely. Then, the grip roller 203 is driven 60 steps in the forwarding direction and the paper 212 is conveyed in the printing direction (the direction of arrow A in FIG. 2). Then, the initial position of the second image 912 of the panoramic image of the paper 212 is made to come to the position of the heating elements of the thermal head 209. In the present embodiment, the sublimation dye ink layer of the first image 911 and second image 912 of the panoramic image 910 are formed so as to be in contact. However, a part of the sublimation dye ink layer of the first image (the trailing edge portion) and of the second image (the leading edge portion) may overlap. In this case, however, it is necessary to overlap the ink layers (601-603 and 605-607) of the first image 911 and second image 912 in a way that the ink layers (605-607 of FIG. 6) of the sublimation dye ink layer of the second image 912 are not formed on the OP layer 604 of the first image 911.

Then, in steps S22 to S29, the sublimation dye ink layers 605-607 of the second image of the panoramic image are formed, as done in steps S5 to S12, described above, wherein the sublimation dye ink layers 601-603 of the first image of the panoramic image are formed. By this processing, as depicted in FIG. 6, the yellow (Y) color sublimation dye ink layer 605, magenta (M) color sublimation dye ink layer 606 and the cyan (C) sublimation dye ink layer 607 are formed so as to be in contact with the sublimation dye ink layers 601-603 of the first image 911.

Next, the process proceeds to step S30, the platen roller 204 moves away to the retracted position, and the grip roller 203 is rotationally driven 4616 steps in the direction opposite to the direction of printing. In this way, the paper 212 is fed back until the trailing edge of the overcoat (OP) layer 604 of the first image formed atop the paper 212 comes to the heating elements of the thermal head 209. It should be noted that, because with the first image, the overcoat (OP) layer 604 is only formed 4220 steps, as opposed to the length of 4400 steps, it is necessary in step S30 to be fed back at least 4580 steps. However, considering the precision of the conveyance mechanism of the paper 212, in order that the trailing edge of the OP layer 604 of the first image and the leading edge of the OP layer 608 of the second image partially overlap, the paper 212 is fed back an excess of 36 steps (total 4580+36=4616 (steps)). In this way, with respect to the second image 912, when transferring the coating material (OP portion 704 in FIG. 9), the coating material (OP portion 704) is transferred such that its transfer starts at least the afore-described length (5 mm=180 steps) from the trailing edge of the first image.

In step S31, cueing of the OP portion 704 of the ink sheet is performed. Then, in step S32, by thermally driving the heating elements of the thermal head 209, the transparent resin (OP portion) 704 is transferred to the paper 212. As the result, the transparent coating layer 608 of the second image 912 is formed. Here, while carrying out transfer processing of the OP portion 704 for the second image 912, the paper 212 is fed 4652 steps from the trailing edge of the overcoat (OP) layer 604 of the first image in the printing direction, such that the overcoat (OP) layer 608 of the second image 912 is formed as shown in FIG. 6. By the processing explained above, the second image 912 of the panoramic (wide) image 910 is formed on the paper 212. As the result, the panoramic (wide) image 910 having width of two L size is printed on the paper 212.

It should be noted that, in the present embodiment, the OP layers 604, 608 of the first and second images of the panoramic image are transferred having an overlap of a motor drive step count of 36 steps, corresponding to approximately 1 mm (=0.0845×36/3) (not shown in FIG. 6). However, processing may also be carried out such that the OP layers of the first and second images of the panoramic image are in contact.

After this, when printing of the panoramic image 910 is complete, the process proceeds to step S33, the platen roller 204 is moved away to the retracted position, and the grip roller 203 is rotationally driven in a direction opposite to the printing direction. Then, the paper 212 is fed back so that the cutting position (around the end of the second image) of the paper 212 comes to the position of the cutter 211, and cutting of the paper 212 is carried out by the cutter 211. Then, the process proceeds to step S34, and the paper cut in step S33 is conveyed into a nip of a pair of the output rollers 207, conveyed in the discharge direction, and the paper, on which printing is complete, is discharged outside the printer. With the above processing, printing of the panoramic image is complete.

It should be noted that, in the present embodiment, an explanation has been made of processing to transfer (print) a panoramic image of two L size images. However, the present invention is not limited to printing of the size of images, but may also be applied in cases where multiple images are printed in contact with each other. For example, it is also possible to apply the present invention to a case wherein transfer (printing) is carried out on an image of 2 L size, in which two images of L size are printed in contact. Further, when images are adjacently transferred using an ink sheet, the processing according to the present invention is also effect in cases where the images are transferred in contact in portions or where regions of the images overlap.

It should be noted that, while the gap length between the trailing edge of the ink layer and the trailing edge of the OP layer of the first image is set to 5 mm with the L size, it is possible to change this gap length corresponding to the size of a transferred image or thermal head temperature (the heat accumulation state of the thermal head). It should be noted that this gap length may optionally be set by the CPU 101.

For example, if the size of an image is large, the gap length to be set may be large; if the size of an image is small, the gap length may be small. In this way, if the gap length is set proportional to the size of a transferred image, because an OP layer having the same aspect ratio is formed, even when the image size varies, the OP layer is changed over at the same place relative to the image center. Further, it is also possible to use a common processing algorithm for several sizes of an image.

Further, when combining multiple images using image processing and printing the images, the gap length may be set so as to match the width of the portion on which processing is carried out to place overlapping images when combining the images.

Further, if the head temperature (the heat accumulation state of the thermal head) is high, when transferring the ink portion for the second image, it is possible that heat is transferred to the OP layer of the first image. As the result, the ink portion for the second image and the OP layer of the first image stick to each other. Therefore, when the head temperature is high or when there is a strong possibility the head temperature will become high (in cases where overlapping image portions have high density), in order to avoid heat transfer, the gap length may be set long.

For example, when the gap length is changed corresponding to the head temperature, the head temperature may be detected by a temperature sensor provided in the vicinity of the thermal head and the gap length may be decided corresponding to a detected temperature. Further, when, in a first main scanning line of the second image or among the dots of the first few main scanning lines, there is an area of higher dot density than a threshold value set in advance, the gap length may be set longer. Or, when, the average dot density of the first main scanning line of the second image or the first few main scanning lines is calculated and the calculated average dot density is higher than a predetermined density, the gap length may be set longer. In this way, it is prevented that the ink sheet is stuck to a paper due to the heat transmission. Further, when, as described above, a judgment is made about the head temperature or the dot density, and the temperature is not high or the head temperature is unlikely to be high (when the dot density of the overlapping image portion is low), because the possibility of the transmission of heat is low, the gap length may be set shorter.

Figure 7B:
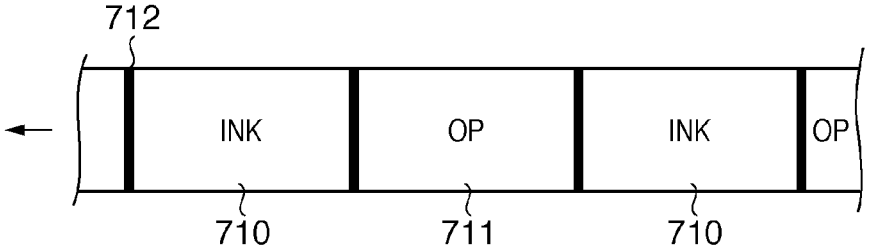
Figure 8:
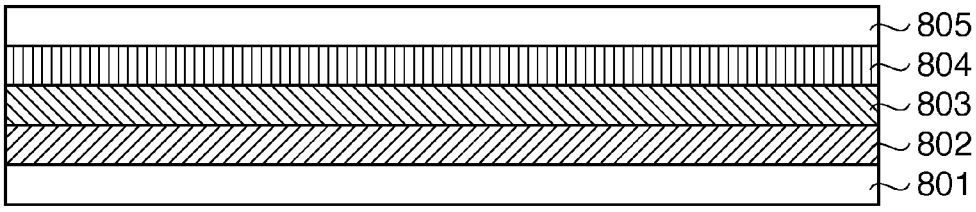
FIG. 8 depicts a view illustrating a cross-section of a paper onto which Y, M and C ink (sublimation dye) is transferred using the ink sheet of FIG. 7A.

It should be noted that in the above description, explanation was made with the case of printing color images, however, the present invention is not limited to this and, of course, it may also be applied to the case of printing monochrome images. The ink sheet used for printing monochrome images is an ink sheet whereby a sublimation dye-based ink portion and a thermo-melting coating material is repeatedly arranged frame-sequentially as shown in FIG. 7B.

OTHER EMBODIMENTS

The embodiments of the present invention have been described in detail. Note that the present invention can also be achieved by directly or remotely supplying a program of software that implements the functions of the aforementioned embodiments to a system or apparatus, and reading out and executing the supplied program code by a computer of that system or apparatus. In this case, the form of program is not particularly limited as long as it has the program function.

Therefore, the program code itself installed in a computer to implement the functional processing of the present invention using the computer implements the present invention. That is, the claims of the present invention include the computer program itself for implementing the functional processing of the present invention. In this case, the form of program is not particularly limited, and an object code, a program to be executed by an interpreter, script data to be supplied to an OS, and the like may be used as long as they have the program function.

As a printing medium for supplying the program, various media can be used: for example, a Floppy® disk, hard disk, optical disk, magneto-optical disk, MO, CD-ROM, CD-R, CD-RW, magnetic tape, nonvolatile memory card, ROM, DVD (DVD-ROM, DVD-R), and the like.

As another program supply method, a program can be supplied by establishing a connection to a home page on the Internet using a browser on a client computer, and downloading the program from the home page to a printing medium such as a hard disk or the like. In this case, the program to be downloaded may be either the computer program itself of the present invention or a compressed file including an automatic installation function. Furthermore, the program code that configures the program of the present invention may be segmented into a plurality of files, which may be downloaded from different home pages. That is, the claims of the present invention include a WWW server which makes a plurality of users download a program file required to implement the functional processing of the present invention by a computer.

Also, a storage medium such as a CD-ROM or the like, which stores the encrypted program of the present invention, may be delivered to the user. In this case, the user who has cleared a predetermined condition may be allowed to download key information that decrypts the encrypted program from a home page via the Internet, so as to install the encrypted program in a computer in an executable form using that key information.

The functions of the aforementioned embodiments may be implemented by a mode other than that by executing the readout program code by the computer. For example, an OS or the like running on the computer may execute some or all of actual processes on the basis of an instruction of that program, thereby implementing the functions of the aforementioned embodiments.

Furthermore, the program read out from the printing medium may be written in a memory equipped on a function expansion board or a function expansion unit, which is inserted in or connected to the computer. In this case, after the program is written in the memory, a CPU or the like equipped on the function expansion board or unit executes some or all of actual processes based on the instruction of that program, thereby implementing the functions of the aforementioned embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2008-001644, filed Jan. 8, 2008, which is hereby incorporated by reference herein in its entirety.

The invention claimed is:

1. A thermal printer for printing an image on a printing medium using an ink sheet that repeatedly arranges a set, which contains a plurality of sublimation dye-based color ink portions and a thermo-melting coating material, the printer comprising:

printing means for printing an image on a printing medium using a set of the plurality of sublimation dye-based color ink portions and the thermo-melting coating material of the ink sheet; and control means for (i) causing said printing means to print a first image using a plurality of sublimation dye-based color ink portions of a first set and transfer a thermo-melting coating material of the first set on the printed first image to form a first coating layer, and then to print a second image adjacent to the printed first image using a plurality of sublimation dye-based color ink portions of a second set and transfer a thermo-melting coating material of the second set on the printed second image to form a second coating layer, and (ii) controlling printing of the first and second images and forming of the first and second coating layers such that, (a) the trailing edge of the first coating layer is at a position which does not reach the trailing edge of the printed first image, and (b) the leading edge of the second coating layer is either the same as the trailing edge of the first coating layer or overlaps the trailing edge of the first coating.

2. The thermal printer according to claim 1, wherein said printing means comprises:

transfer means for forming a color image by transferring the respective colors of the plurality of sublimation dye-based color ink portions of the ink sheet onto the printing medium; and coating means for forming the coating layer by transferring the thermo-melting coating material onto the color image formed by said transfer means.

3. The thermal printer according to claim 1, wherein the ink sheet is an ink sheet whereby each of a set of the plurality of sublimation dye-based color ink portions and the thermo-melting coating material is frame-sequentially arranged repeatedly in the longitudinal direction of the ink sheet.

4. A thermal printer for printing an image on a printing medium using an ink sheet having a set of a sublimation dye-based ink portion and a thermo-melting coating material, which is frame-sequentially arranged repeatedly, the thermal printer comprising:

printing means for printing an image on a printing medium using a set of the sublimation dye-based ink portion and the thermo-melting coating material of the ink sheet; and control means for (i) causing said printing means to print a first image using a plurality of sublimation dye-based color ink portions of a first set and transfer a thermo-melting coating material of the first set on the printed first image to form a first coating layer, and then to print a second image adjacent to the printed first image using a plurality of sublimation dye-based color ink portions of a second set and transfer a thermo-melting coating material of the second set on the printed second image to form a second coating layer, and (ii) controlling printing of the first and second images and forming of the first and second coating layers such that, (a) the trailing edge of the first coating layer is at a position which does not reach the trailing edge of the printed first image, and (b) the leading edge of the second coating layer is either the same as the trailing edge of the first coating layer or overlaps the trailing edge of the first coating layer.

5. The thermal printer according to claim 4, wherein said printing means comprises:

transfer means for forming an image by transferring the sublimation dye-based ink portion of the ink sheet onto the printing medium; and coating means for forming the coating layer by transferring the thermo-melting coating material of the ink sheet onto the image formed by said transfer means.

6. The thermal printer according to claim 4, wherein the ink sheet is an ink sheet whereby each of a set of the sublimation dye-based ink portion and the thermo-melting coating material is frame-sequentially arranged repeatedly in the longitudinal direction of the ink sheet.

7. The thermal printer according to claim 1, wherein said printing means has a thermal head, which has multiple heating elements provided in a main scanning direction, and conveys the printing medium in a sub-scanning direction, which is orthogonal to the main scanning direction, to transfer an image to the printing medium.

8. The thermal printer according to claim 7, wherein the printing medium is a rolled paper and the first and second images are printed on the printing medium adjacently, in the sub-scanning direction.

9. The thermal printer according to claim 7, wherein, in a case that the first coating layer is formed, said control means controls such that the conveyance length of the printing medium is a fixed distance shorter than the conveyance length of the printing medium when the first image is printed onto the printing medium and, wherein, in a case that the second coating layer is formed, said control means controls such that the thermo-melting coating material is transferred starting from a position at least the fixed distance of the first coating layer until the trailing edge of the printed second image.

10. The thermal printer according to claim 4, wherein a gap length between the trailing edge of the printed first image and the trailing edge of the first coating layer is set corresponding to the size of the printed first image.

11. The thermal printer according to claim 7, wherein a gap length between the trailing edge of the printed first image and the trailing edge of the first coating layer is changed corresponding to the temperature of the thermal head.

12. The thermal printer according to claim 7, wherein a gap length between the trailing edge of the printed first image and the trailing edge of the first coating layer is set corresponding to the dot density of the first main scanning line of the second image.

13. A control method of a thermal printer for printing an image on a printing medium using an ink sheet that repeatedly arranges a set, which contains a plurality of sublimation dye-based color ink portions and a thermo-melting coating material, and for printing a second image, capable of being printed using the set of sublimation dye-based color ink portions and thermo-melting coating material, adjacent to a first image printed on the printing medium, the method comprising:

printing a first image on a printing medium using a plurality of sublimation dye-based color ink portions of a first set and transferring a thermo-melting coating material of the first set on the printed first image to form a first coating layer;

printing a second image adjacent to the printed first image on the printing medium using a plurality of sublimation dye-based color ink portions of a second set and transferring a thermo-melting coating material of the second set on the printed second image to form a second coating layer; and controlling, such that the trailing edge of the first coating layer is at a position which does not reach the trailing edge of the printed first image and the start position of the second coating layer is either the same as the trailing edge of the first coating layer or overlaps the trailing edge of the first coating layer.

14. A control method of a thermal printer for printing an image on a printing medium using an ink sheet that repeatedly arranges a set, which contains a sublimation dye-based ink portion and a thermo-melting coating material, and for printing a second image, capable of being printed using the set of the sublimation dye-based ink portion and the thermo-melting coating material, adjacent to the first image printed on the printing medium, the method comprising:

printing a first image on a printing medium using a plurality of sublimation dye-based color ink portions of a first set and transferring a thermo-melting coating material of the first set on the printed first image to form a first coating layer;

printing a second image adjacent to the printed first image on the printing medium using a plurality of sublimation dye-based color ink portions of a second set and transferring a thermo-melting coating material of the second set on the printed second image to form a second coating layer; and controlling, such that the trailing edge of the first coating layer is at a position which does not reach the trailing edge of the printed first image and the start position of the second coating layer is either the same as the trailing edge of the first coating layer or overlaps the trailing edge of the first coating layer.

15. A thermal printer for printing an image on a printing medium using an ink sheet that repeatedly arranges a set, which contains a sublimation dye-based color ink portion and a thermo-melting coating material, the printer comprising:

printing means for printing an image on a printing medium using a set of the sublimation dye-based color ink portion and the thermo-melting coating material of the ink sheet and for transferring the thermo-melting coating material on an image area transferred using the sublimation dye-based color ink portion; and control means for (i) causing said printing means to print a first image using a plurality of sublimation dye-based color ink portions of a first set and to transfer a thermo-melting coating material of the first set on the printed first image to form a first coating layer, and then to print a second image adjacent to the printed first image using a plurality of sublimation dye-based color ink portions of a second set and transfer a thermo-melting coating material of the second set on the printed second image to form a second coating layer, and (ii) controlling said printing means to form the first coating layer on the first printed image except for an area of the first printed image that is close to the second printed image.

* * * * *